US007568696B2

(12) United States Patent
Henson

(10) Patent No.: US 7,568,696 B2
(45) Date of Patent: Aug. 4, 2009

(54) ITEM PRINTING SYSTEM

(75) Inventor: Walter Herbert Henson, Essex (GB)

(73) Assignee: Neopost Limited, Essex (GB)

( * ) Notice: Subject to any disclaimer, the term of this patent is extended or adjusted under 35 U.S.C. 154(b) by 398 days.

(21) Appl. No.: 10/503,179

(22) PCT Filed: Jan. 31, 2003

(86) PCT No.: PCT/GB03/00394

§ 371 (c)(1),
(2), (4) Date: Dec. 15, 2005

(87) PCT Pub. No.: WO03/064164

PCT Pub. Date: Aug. 7, 2003

(65) Prior Publication Data

US 2007/0134043 A1 Jun. 14, 2007

(30) Foreign Application Priority Data

Jan. 31, 2002 (GB) ..... 0202200.2

(51) Int. Cl.
*B65H 5/34* (2006.01)

(52) U.S. Cl. ..... 271/270; 271/272; 271/274

(58) Field of Classification Search ..... 271/270, 271/272, 273, 274; 347/104
See application file for complete search history.

(56) References Cited

U.S. PATENT DOCUMENTS 4,519,700 A * 5/1985 Barker et al. ..... 399/394

FOREIGN PATENT DOCUMENTS

EP 0 376 576 7/1990
EP 1 156 456 11/2001

* cited by examiner

*Primary Examiner*—David H Bollinger
(74) *Attorney, Agent, or Firm*—Sughrue Mion, PLLC

(57) ABSTRACT

An item printing system for printing imprints on moving items, comprising: an item transport path through which items are in use transported in a transport direction; an item transport unit for transporting items through the item transport path; a printing unit (11) for printing imprints on items transported through the item transport path; a free roller (27) driven by respective items transported through the item transport path; and a speed measurement unit for measuring speed of rotation of the free roller, wherein the measured speed of rotation of the free roller is utilised to provide relative control of printing by the printing unit and speed of transport of items by the item transport unit.

23 Claims, 1 Drawing Sheet

ITEM PRINTING SYSTEM

Figure 1:
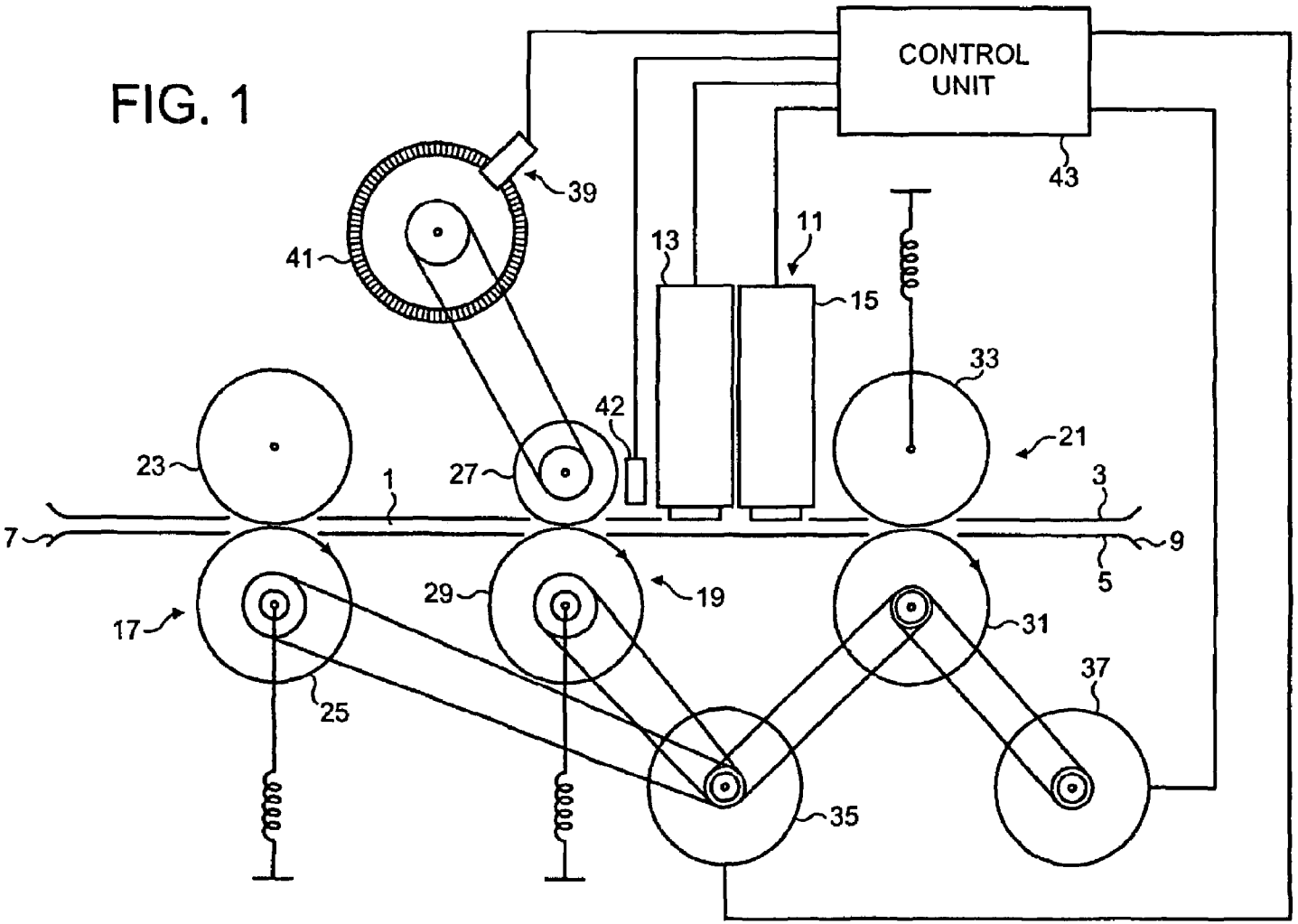

This application is a national phase of International Application No. PCT/GB03/00394 filed Jan. 31, 2003 and published in English language.

The present invention relates to an item printing system for printing imprints on moving items, in particular a mail printing system for printing indicia on mail items.

In a printing system, where driven rollers for transporting items are directly connected to a drive unit, typically a dc motor, one would expect the transport speed to be substantially constant. The present applicant has, however, recognized that this is not the case. In a system utilizing gears, the gears can suffer from backlash, which leads to a variation in the transport speed. And, in a system utilizing toothed belts, the belts can ride up on the drive teeth, leading to a variation in the transport speed. Also, the supply voltage for a drive motor can fluctuate, leading to a corresponding variation in the speed of the drive motor.

It is thus an aim of the present invention to provide an improved item printing system for printing imprints on moving items, and in particular a mail printing system for printing indicia on mail items.

In one aspect the present invention provides an item printing system for printing imprints on moving items, comprising: an item transport path through which items are in use transported in a transport direction; an item transport unit for transporting items through the item transport path; a printing unit for printing imprints on items transported through the item transport path; a free roller driven by respective items transported through the item transport path; a speed measurement unit for measuring speed of rotation of the free roller; and a control unit for controlling rate of printing by the printing unit in response to the measured speed of rotation of the free roller.

Preferably, the printing unit comprises first and second print heads spaced in the transport direction.

In one embodiment the free roller comprises a fixed roller.

In another embodiment the free roller comprises a floating roller biased towards the item transport path.

Preferably, the free roller is disposed upstream of the printing unit.

Preferably, the item transport unit comprises a drive roller assembly comprising the free roller and a driven roller disposed opposite the free roller, which rollers act to engage an item and transport the same along the item transport path.

In one embodiment the driven roller comprises a fixed roller.

In another embodiment the driven roller comprises a floating roller biased towards the free roller.

Preferably, the speed measurement unit comprises a tachometer unit for measuring speed of rotation of the free roller, the tachometer unit including an encoder wheel coupled to the free roller.

Preferably, the items comprise mail items.

In another aspect the present invention provides an item printing system for printing imprints on moving items, comprising: an item transport path through which items are in use transported in a transport direction; an item transport unit for transporting items through the item transport path; a printing unit for printing imprints on items transported through the item transport path; a free roller driven by respective items transported through the item transport path; a speed measurement unit for measuring speed of rotation of the free roller; and a control unit for controlling speed of transport of mail items by the item transport unit in response to the measured speed of rotation of the free roller.

Preferably, the printing unit comprises first and second print heads spaced in the transport direction.

In one embodiment the free roller comprises a fixed roller.

In another embodiment the free roller comprises a floating roller biased towards the item transport path.

Preferably, the free roller is disposed upstream of the printing unit.

Preferably, the item transport unit comprises a drive roller assembly comprising the free roller and a driven roller disposed opposite the free roller, which rollers act to engage an item and transport the same along the item transport path.

In one embodiment the driven roller comprises a fixed roller.

In another embodiment the driven roller comprises a floating roller biased towards the free roller.

Preferably, the speed measurement unit comprises a tachometer unit for measuring speed of rotation of the free roller, the tachometer unit including an encoder wheel coupled to the free roller.

Preferably, the items comprise mail items.

In a further aspect the present invention provides an item printing system for printing imprints on moving items, comprising: an item transport path through which items are in use transported in a transport direction; an item transport unit for transporting items through the item transport path; a printing unit for printing imprints on items transported through the item transport path; a free roller driven by respective items transported through the item transport path; and a speed measurement unit for measuring speed of rotation of the free roller, wherein the measured speed of rotation of the free roller is utilised to provide relative control of printing by the printing unit and speed of transport of items by the item transport unit.

A preferred embodiment of the present invention will now be described hereinbelow by way of example only with reference to the accompanying drawing, in which:

FIG. 1 schematically illustrates a mail printing system in accordance with a preferred embodiment of the present invention.

The mail printing system comprises a mail transport path 1, in this embodiment defined by first and second spaced, parallel plates 3, 5, through which mail items are transported from an inlet end 7 to an outlet end 9.

The mail printing system further comprises a printing unit 11 for printing indicia on mail items transported through the mail transport path 1. In this embodiment the printing unit 11 comprises first and second print heads 13, 15, each being configured to print part, here half, of an indicium. With this configuration, indicia, which have a greater height than a single one of the print heads 13, 15, can be printed in a single pass. This configuration does, however, necessitate that the print heads 13, 15 be staggered in the mail transport direction, which results in the upper and lower parts of an indicium being printed at different times. As a result of the upper and lower parts of the indicium being printed at different times, the resulting print is particularly sensitive to variations in the transport speed of the mail item, as, if the transport speed of the mail item changes during printing of the indicium, the separately-printed parts of the indicium will be misaligned.

The mail printing system further comprises a mail transport unit for transporting mail items through the mail transport path 1, which unit comprises first, second and third drive roller assemblies 17, 19, 21.

The first drive roller assembly 17 is disposed upstream of the printing unit 11 at the inlet end 7 of the mail transport path 1. The first drive roller assembly 17 comprises a first, free idler roller 23, in this embodiment of fixed position, which is disposed to one, in this embodiment the upper, side of the mail transport path 1, and a second, driven roller 25, in this embodiment a floating roller which is biased towards the first, idler roller 23, which rollers 23, 25 act to engage a mail item introduced into the mail transport path 1 and transport the mail item downstream towards the printing unit 11.

The second drive roller assembly 19 is disposed in the mail transport path 1 intermediate the printing unit 11 and the first drive roller assembly 17, in this embodiment adjacent the printing unit 11. The second drive roller assembly 19 comprises a first, free idler roller 27, in this embodiment of fixed position, which is disposed to one, in this embodiment the upper, side of the mail transport path 1, and a second, driven roller 29, in this embodiment a floating roller which is biased towards the first, idler roller 27, which rollers 27, 29 act to engage a mail item and transport the mail item downstream through the printing unit 11.

The third drive roller assembly 21 is disposed in the mail transport path 1 downstream of the printing unit 11 at the outlet end 9 of the mail transport path 1, in this embodiment adjacent the printing unit 11. The third drive roller assembly 21 comprises a first, driven roller 31, in this embodiment a fixed roller, which is disposed to one, in this embodiment the lower, side of the mail transport path 1, and a second, free idler roller 33, in this embodiment a floating roller which is biased towards the first, driven roller 31, which rollers 31, 33 act to engage a mail item transported beyond the printing unit 11 and transport the mail item downstream of the printing unit 11 and eject the same from the mail transport path 1.

The mail transport unit further comprises a first drive unit 35, in this embodiment a dc motor, which is coupled to each of the driven rollers 25, 29, 31 of the first, second and third drive roller assemblies 17, 19, 21 such as to drive the same at a predeterminable speed. In this embodiment the first drive unit 35 is coupled by respective belts to the driven rollers 25, 29, 31 of the first, second and third drive roller assemblies 17, 19, 21. In another embodiment the first drive unit 35 could comprise a stepper motor.

The mail transport unit further comprises a second drive unit 37, in this embodiment a dc motor, which is coupled to the driven roller 31 of the third drive roller assembly 21 such as to enable the driven roller 31 of the third drive roller assembly 21 to be driven at a speed greater than that of the driven rollers 25, 29 of the first and second drive roller assemblies 17, 19, thereby allowing mail items to be ejected from the mail transport path 1. In this embodiment the first and second drive units 35, 37 are coupled to the driven roller 31 of the third drive roller assembly 21 by a clutch arrangement such as to enable the selective operation of the second drive unit 37 to drive the driven roller 31 of the third drive roller assembly 21, and thereby enable the ejection of mail items from the mail transport path 1. In this embodiment the second drive unit 37 is coupled by a belt to the driven roller 31 of the third drive roller assembly 21. In another embodiment the second drive unit 37 could comprise a stepper motor.

The mail transport system further comprises a tachometer unit 39 for measuring the speed of rotation of the idler roller 27 of the second drive roller assembly 19, and hence the transport speed of mail items transported through the mail transport path 1. The tachometer unit 39 includes an encoder wheel 41 which is coupled to the idler roller 27 of the second drive roller assembly 19 such that the tachometer unit 39 is driven directly by the mail items passing through the second drive roller assembly 19, with the tachometer unit 39 providing an output signal representative of the speed of rotation of the idler roller 27 of the second drive roller assembly 19, and hence the transport speed of mail items transported through the mail transport path 1. In this embodiment the encoder wheel 41 of the tachometer unit 39 is coupled to the idler roller 27 of the second drive roller assembly 19 by a belt. In another embodiment the encoder wheel 41 of the tachometer unit 39 could be connected directly to the shaft of the idler roller 27 of the second drive roller assembly 19.

The mail transport system further comprises a sensor 42 which, in this embodiment, is disposed intermediate the printing unit 11 and the second drive roller assembly 19 to detect the transport of the leading edge of a mail item beyond a predetermined location upstream of the printing unit 11.

The mail transport system further comprises a control unit 43 for receiving the output signals from the tachometer unit 39 and the sensor 42, and controlling the printing unit 11 and the first and second drive units 35, 37 in response thereto. In this embodiment the control unit 43 is configured to control the rate of printing of the print heads 13, 15 of the printing unit 11 in response to the measured speed of rotation of the idler roller 27 of the second drive roller assembly 19. With this configuration, the rate of printing of indicia is controlled in response to the speed of transport of mail items such that indicia are printed on mail items which are of the required size and form, that is, not stretched or compressed as would be achieved by a mail item being transported at too high or too low a speed, and the parts of which are not misaligned. In another embodiment the control unit 43 can be configured to control the speed of the first drive unit 35 in response to the measured speed of rotation of the idler roller 27 of the second drive roller assembly 19. With this configuration, the speed of transport of mail items is controlled such that, for a predeterminable rate of printing, indicia are printed on mail items which are of the required size and form, that is, not stretched or compressed as would be achieved by a mail item being transported at too high or too low a speed, and the parts of which are not misaligned.

Operation of the above-described mail printing system will now be described hereinbelow.

A mail item is first introduced into the inlet end 7 of the mail transport path 1. The mail item is then engaged by the first drive roller assembly 17 which acts to transport the mail item downstream along the mail transport path 1 towards the printing unit 11. The mail item is subsequently engaged by the second drive roller assembly 19 which acts to transport the mail item downstream along the mail transport path 1 through the printing unit 11. While the mail item is engaged by the second drive roller assembly 19, the encoder wheel 41 of the tachometer unit 39 is driven by the idler roller 27 of the second drive roller assembly 19 at a speed corresponding to the transport speed of the mail item.

The sensor 42 then detects the transport of the leading edge of the mail item beyond a predetermined location upstream of the printing unit 11. The control unit 43 is responsive to detection by the sensor 42 to actuate the printing unit 11 following transport of the mail item by a predetermined distance, as determined from the measured speed of the idler roller 27 of the second drive roller assembly 19 and provided by the output of the tachometer unit 39.

The printing unit 11, under the control of the control unit 43, prints an indicium line-by-line, with the rate of printing being controlled according to the measured speed of the idler roller 27 of the second drive roller assembly 19.

The mail item is then engaged by the third drive roller assembly 21, such that the mail item is commonly engaged by both the second and third drive roller assemblies 19, 21. While the mail item is engaged by both the second and third drive roller assemblies 19, 21, the rate of printing is still controlled according to the measured speed of the idler roller 27 of the second drive roller assembly 19 until the printing of the indicium has been completed.

With continued transport of the mail item through the mail transport path 1, the mail item is subsequently engaged by only the third drive roller assembly 21, and the second drive unit 37 is then actuated to drive the driven roller 31 of the third drive roller assembly 21 at a faster speed in order to eject the mail item.

In an alternative embodiment, as described hereinabove, the rate of printing by the print heads 13, 15 of the printing unit 11 is set at a predeterminable rate, and the control unit 43 controls the speed of the first drive unit 35 in response to the measured speed of rotation of the idler roller 27 of the second drive roller assembly 19, such that, for the predeterminable rate of printing, indicia are printed on mail items which are of the required size and form.

Finally, it will be understood that the present invention has been described in its preferred embodiment and can be modified in many different ways without departing from the scope of the invention as defined by the appended claims.

The invention claimed is:

1. An item printing system for printing imprints on moving items, comprising:
- an item transport path through which items are in use transported in a transport direction;
- an item transport unit for transporting items through the item transport path;
- a printing unit for printing imprints on items transported through the item transport path;
- a free roller driven by respective items transported through the item transport path;
- a speed measurement unit for measuring speed of rotation of the free roller; and
- a control unit for controlling rate of printing by the printing unit in response to the measured speed of rotation of the free roller.

2. The system of claim 1, wherein the free roller comprises a fixed roller.

3. The system of claim 1, wherein the free roller comprises a floating roller biased towards the item transport path.

4. The system of claim 1, wherein the item transport unit comprises a drive roller assembly comprising the free roller and a driven roller disposed opposite the free roller, which rollers act to engage an item and transport the same along the item transport path.

5. The system of claim 4, wherein the driven roller comprises a fixed roller.

6. The system of claim 4, wherein the driven roller comprises a floating roller biased towards the free roller.

7. The system of claim 1, wherein the speed measurement unit comprises a tachometer unit for measuring speed of rotation of the free roller, the tachometer unit including an encoder wheel coupled to the free roller.

8. The system of claim 1, wherein the items comprise mail items.

9. An item printing system for printing imprints on moving items, comprising:
- an item transport path through which items are in use transported in a transport direction;
- an item transport unit for transporting items through the item transport path:
- a printing unit for printing imprints on items transported through the item transport path, wherein the printing unit comprises first and second print heads spaced in the transport directions;
- a free roller driven by respective items transported through the item transport path;
- a speed measurement unit for measuring speed of rotation of the free roller; and
- a control unit for controlling rate of printing by the printing unit in response to the measured speed of rotation of the free roller.

10. An item printing system for printing imprints on moving items, comprising:
- an item transport path through which items are in use transported in a transport direction;
- an item transport unit for transporting items through the item transport path;
- a printing unit for printing imprints on items transported through the item transport path;
- a free roller driven by respective items transported through the item transport path, wherein the free roller is disposed upstream of the printing units;
- a speed measurement unit for measuring speed of rotation of the free roller; and
- a control unit for controlling rate of printing by the printing unit in response to the measured speed of rotation of the free roller.

11. An item printing system for printing imprints on moving items, comprising:
- an item transport path through which items are in use transported in a transport direction;
- an item transport unit for transporting items through the item transport path;
- a printing unit for printing imprints on items transported through the item transport path;
- a free roller driven by respective items transported through the item transport path;
- a speed measurement unit for measuring speed of rotation of the free roller; and
- a control unit for controlling speed of transport of mail items by the item transport unit in response to the measured speed of rotation of the free roller.

12. The system of claim 11, wherein the free roller comprises a fixed roller.

13. The system of claim 11, wherein the free roller comprises a floating roller biased towards the item transport path.

14. The system of claim 11, wherein the item transport unit comprises a drive roller assembly comprising the free roller and a driven roller disposed opposite the free roller, which rollers act to engage an item and transport the same along the item transport path.

15. The system of claim 14, wherein the driven roller comprises a fixed roller.

16. The system of claim 14, wherein the driven roller comprises a floating roller biased towards the free roller.

17. The system of claim 11, wherein the speed measurement unit comprises a tachometer unit for measuring speed of rotation of the free roller, the tachometer unit including an encoder wheel coupled to the free roller.

18. The system of claim 11, wherein the items comprise mail items.

19. An item printing system for printing imprints on moving items, comprising:
- an item transport path through which items are in use transported in a transport direction;
- an item transport unit for transporting items through the item transport path;
- a printing unit for printing imprints on items transported through the item transport path, wherein the printing unit comprises first and second print heads spaced in the transport directions;
- a free roller driven by respective items transported through the item transport path;

a speed measurement unit for measuring speed of rotation of the free roller; and a control unit for controlling speed of transport of mail items by the item transport unit in response to the measured speed of rotation of the free roller.

20. An item printing system for printing imprints on moving items, comprising:

an item transport path through which items are in use transported in a transport direction;

an item transport unit for transporting items through the item transport path;

a printing unit for printing imprints on items transported through the item transport path;

a free roller driven by respective items transported through the item transport path, wherein the free roller is disposed upstream of the printing units;

a speed measurement unit for measuring speed of rotation of the free roller; and a control unit for controlling speed of transport of mail items by the item transport unit in response to the measured speed of rotation of the free roller.

21. An item printing system for printing imprints on moving items, comprising:

an item transport path through which items are in use transported in a transport direction;

an item transport unit for transporting items through the item transport path;

a printing unit for printing imprints on items transported through the item transport path;

a free roller driven by respective items transported through the item transport path; and a speed measurement unit for measuring speed of rotation of the free roller, wherein the measured speed of rotation of the free roller is utilised to provide relative control of printing by the printing unit and speed of transport of items by the item transport unit.

22. An item printing system for printing imprints on moving items, comprising: an item transport path through which items are in use transported in a transport direction;

an item transport unit for transporting items through the item transport path;

a printing unit for printing imprints on items transported through the item transport path, wherein the printing unit comrrises first and second print heads spaced in the transport direction;

a free roller driven by respective items transported through the item transport path; and a speed measurement unit for measuring speed of rotation of the free roller, wherein the measured speed of rotation of the free roller is utilised to provide relative control of printing by the printing unit and speed of transport of items by the item transport unit.

23. An item printing system for printing imprints on moving items, comprising:

an item transport path through which items are in use transported in a transport direction;

an item transport unit for transporting items through the item transport path;

a printing unit for printing imprints on items transported through the item transport path;

a free roller driven by respective items transported through the item transport path, wherein the free roller is disposed upstream of the printing unit; and a speed measurement unit for measuring speed of rotation of the free roller, wherein the measured speed of rotation of the free roller is utilised to provide relative control of printing by the printing unit and speed of transport of items by the item transport unit.

* * * * *